US005135286A

United States Patent [19]

Ripley

[11] Patent Number: 5,135,286

[45] Date of Patent: Aug. 4, 1992

[54] RESIDUE RECOVERY PROCESS AND APPARATUS

[75] Inventor: Ian Ripley, Cleveland, Great Britain

[73] Assignee: Great Eastern (Bermuda) Ltd., New York, N.Y.

[21] Appl. No.: 526,164

[22] Filed: May 21, 1990

[30] Foreign Application Priority Data

May 22, 1989 [GB] United Kingdom ..... 8911752

[51] Int. Cl.[5] ..... C01C 3/12; F21C 41/10; F04B 15/02

[52] U.S. Cl. ..... 299/6; 166/302; 208/39; 208/370; 210/242.3; 299/14; 415/72

[58] Field of Search ..... 299/2, 10, 14, 6; 166/302; 208/39, 370; 210/187, 170, 242.3, 923; 415/72, 73

[56] References Cited

U.S. PATENT DOCUMENTS 2,224,403 12/1940 Lines ..... 137/13 X
3,785,496 1/1974 Smith, Jr. ..... 210/242.3
4,526,514 7/1985 Duverne ..... 210/242.3 X
4,793,767 12/1988 Lundin ..... 415/72 X

FOREIGN PATENT DOCUMENTS 996287 2/1983 U.S.S.R. ..... 208/370
8706556 11/1987 World Int. Prop. O. ..... 210/242.3

*Primary Examiner*—David J. Bagnell
*Attorney, Agent, or Firm*—George A. Skoler

[57] ABSTRACT

The recovery of materials from viscous bodies of petroleum residue and asphalt deposits which contain substantial quantities of the deposits by the use of an induced thermal gradient in a region of such a viscous body in which there is located a screw-like pump.

This is effected by a process and apparatus that utilizes a thermal gradient about a archimedian screw-type pump in the pit or pond where its inlet is proximate of the surface of the pit or pond. The thermal gradient about the pump concentrates less viscous components at the vicinity of the inlet and a positive pressure is applied to assure a flow of residue towards the inlet allowing the lower viscosity materials to be captured and pumped from the pit or pond to a shore facility.

26 Claims, 6 Drawing Sheets

RESIDUE RECOVERY PROCESS AND APPARATUS

BRIEF DESCRIPTION OF THE INVENTION

The process for the removal of petroleum residues of relatively high viscosity from pits and ponds by floating an Archimedean screw-type pump in the pit or pond such that its inlet is proximate of the surface of the pit or pond, providing a thermal gradient about the pump such that less viscous components of the petroleum residues become more highly concentrated in the vicinity of the inlet to the pump, utilizing a positive pressure on a surface layer of the residues in the pit or pond such that a flow of petroleum residue is created toward the inlet to the pump and a petroleum residue composition of a lower viscosity than that of the remainder of the pit or pond is displaced to the inlet of the pump and the displaced residue is pumped from the pit or pond to a shore facility.

BACKGROUND TO THE INVENTION

Throughout the world there are deposits of petroleum residues that are created artificially or naturally. For example, Bahrain pitch derives from the black oil residues of the Caltex Petroleum Corporation refinery [now operated by the affiliated Bahrain Petroleum Company B.S.C. (closed)] located in Sitrah, Bahrain (the largest island of the Bahrain group of islands), generated in the 1938–1942 time period. The residue, apparently with brackish quench water, was deposited in this time period in seven (7) pits creating seven (7) pitch ponds having a total area of about 70,000 square meters. The only changes to this resting body of pitch over the years since 1942 are those gently wrought by natural forces, such as the dusting over by desert sands, evaporation from the searing Asia Minor (Middle East) heat and deposition of rain water and migrated sea water. The black oil residues deposited in the pits were compositionally relatively consistent because they were made primarily over a short period of time while the refinery was being limited to the manufacture of aviation fuel and other "light" cracked hydrocarbon feedstocks. Variability in the pitch was inputted when, during that period, untreated crude oil was fed through the refinery and then deposited into the pits. Thus, "Bahrain pitch", as that term is employed herein and in the claims, means the pitch collected and located in the aforementioned seven (7) ponds, as it was generated in the W.W.II timeframe and modified by natural forces in subsequent years to the year 1987. Its unique past establishes the pitch to be an unique material.

Essentially all of the other black oil residues deposits about the world are "newly" created relative to the creation of the Bahrain pitch ponds. Hardly any of them are more than 30 years old and most of them were formed from residues of a highly diverse nature reflecting the advances in petroleum technology in the years between the formation of Bahrain pitch and this more recent period. Consequently, they possess compositions materially different from Bahrain pitch. The differences in chemical composition of Bahrain pitch from other black oil residue deposits can be seen from the differences in physical properties of Bahrain pitch and the other black oil residue deposits. One factor that stands out about Bahrain pitch is its high viscosity. In this regard, Bahrain pitch's viscosity fits somewhere between conventional residue deposits and the naturally occurring bitumens used primarily for making asphalt. This high viscosity is a reflection of the pitch's unusually high paraffinic and crystalline wax contents and its high asphaltenes content. Most of the world's black oil residues contain individually no more than about 10 weight % of these materials whereas Bahrain pitch contains more than about 20 weight % of them. In addition to this high wax and asphaltenes content, Bahrain pitch has an inordinately high crystallized carbon content.

The special black oil residues used in forming the Bahrain pitch coupled with the environmental considerations extant during the history of the ponds caused to be generated a unique composition of matter. The quiescent state of its existence allowed the Bahrain pitch to undergo a transformation not unlike that which occurred in naturally-occurring asphaltic bitumens that one finds in countries such as Venezuela and Trinidad. Of course, the limited age of the Bahrain pitch ponds precludes the pitch from reaching the ripe physical state of these other natural bodies. Even so, aromatic molecules within the pitch benefited from the extended quiescent condition to become aligned into large anisotropic bodies which contribute to the pitch's high viscosity. Though such transformation is interesting chemistry, it however transformed Bahrain pitch from a material which theoretically could have been readily exploited for its fuel value. To date, very little of the Bahrain pitch ponds has been mined for any purpose whatsoever and none of that has been for an effective commercial gain.

Unrefined Bahrain pitch has a high viscosity in the range of greater than 40,000 centistokes, as determined at 150° F. (65.6° C.), greater than 6,000 centistokes, as determined at 125° F. (79° C.) and 2–5,000 centistokes, as determined at 200° F. (93° C.) Its A.P.I. at 60° F. (15.5° C.) is less than 0, calculated to be typically −6 to −10 A.P.I.

Unrefined Bahrain pitch comprises as major constituents, 2 to 10 weight percent of total sediments including siliceous particulate matter and carbon particulate matter (generally viewed as crystallized colloidal carbon), 8 to 12 weight percent of paraffinic and microcrystalline waxes, and 20 to 25 weight percent of asphaltenes.

The following table sets forth a summary of the composition and known properties of the Bahrain pitch:

TABLE 1

Typical Specifications from Bahrain Pitch Ponds

| | Neat Pitch | 5%* | 10%** | 15%*** |
|---|---|---|---|---|
| Viscosities @ 38° C. | | | | |
| Centistokes | >20,000 | 11,000 | 1,500 | 900 |
| Redwood (sec.s) | .95,000 | 52,250 | 7,125 | 4,275 |
| Saybolt (sec.s) | 85,000 | 46,750 | 6,375 | 3,825 |
| Ash Content, w/w max. | 0.1 | 0.1 | 0.1 | 0.1 |
| BS & W, % w/w max. | 1 | 1 | 1 | 1 |
| Sulphur Content, % w/w | 4.9 | 4.7 | 4.4 | 4.2 |
| Flash Point °C. | 129 | 61 | 61 | 61 |
| Pour Point °C. | 42. | 29.3 | 27.1 | 15.0 |
| °F. | 107.6 | 86. | 81. | 59. |
| Asphaltenes, % w/w | 24 | 23 | 22 | 20 |

*Diluted by that weight % by diesel or light cycle gas oil.
**Diluted by that weight % by diesel or light cycle gas oil.
***Diluted by that weight % by diesel or light cycle gas oil.

It has been known for some time that the practical limit for cutting unrefined Bahrain pitch with light cycle gas oil or diesel oil is 15–18% w/w. Above this figure precipitation of asphaltenes from solution was recognized as occurring.

The Bahrain pitch as found in the ponds has a significant particulates sediment content ranging in the area of 2 to 10 weight %, give or take a percent, based on the weight of the pitch. Of this sediment content, the inorganic oxide content of the sediment ranges in the area of 0.25 to 5% by weight of the pitch. The inorganic oxide content should be reduced in refining the pitch to the first stage, to between 0.05 to 0.1% by weight of the pitch, and preferably a lesser amount. The remainder of the sediment content of the pitch is particulate carbon matter, such as crystallized colloidal carbon.

According to Nelson, *Petroleum Refinery Engineering*, Fourth Edition, McGraw-Hill Book Company, New York, N.Y., London, at pages 71–72, > "At gravities below 10 API, water and sediment do not settle out of the oil and such oils cannot be displaced from tanks by water."

The properties reflected above with respect to the black oil residues of Bahrain and the residues deposited from refineries elsewhere are more tractable than the naturally-occurring asphaltic bitumens that one finds in countries such as Venezuela (Orinoco basin) and Trinidad. However, in all instances, these highly viscous residues and asphalt containing materials possess substantial viscosities and are of a generally intractable nature.

The most common method employed for the removal of these viscous materials from their landfill deposits has been by shovel, typically mechanically but sometimes by hand. Some efforts have been made to use archimedean screw-type pumps to more continuously remove them from the landfill deposits. None of these procedures have proven totally adequate for an effectively commercial process for recovering such residues and asphaltic materials from the deposits. The exceptionally high viscosities of these materials makes these procedures slow and irregular, thereby materially increasing the cost of the recovery efforts.

There is need in the industrial recovery of petroleum residue and asphalt deposits for a more efficient and effective method for removing the deposits for subsequent treatment. This invention relates to a process and an apparatus sequence that materially enhances ones ability to effect such recovery.

THE INVENTION

This invention stems from the recognition that the petroleum residue deposits as well as asphalt deposits, the world over, possess at least a small amount of less viscous components which if more concentrated in the deposits would aid at selected temperatures in significantly reducing the viscosity of the deposits such that their recovery can be made materially easier to carry out. As indicated above, it is well known that the viscosities of such deposits can be materially reduced by blending a solvent in the deposits. However, such solvents have a materially greater money value than the deposits. As a result, their use greatly increases the cost of the recovered deposit materials and since the deposits possess relatively low commercial value, the use of solvents becomes economically prohibitive. This invention utilizes inherently-present solvents in the residues and asphalts to aid in the reduction of the viscosity of the deposit materials whereby to enhance their recovery for further processing.

The invention relates to the recovery of materials from viscous bodies of petroleum residue and asphalt deposits which contain substantial quantities of the deposits. The invention is concerned with the recovery of viscous petroleum residue and asphalt deposits from pits or ponds of substantial size from which recovery of the deposits are normally difficult to effect. Though the invention is directed primarily to the recovery of petroleum residue and asphalt deposits having gravities below 10 A.P.I. that are located in fairly large and/or deep pits and ponds, it is also applicable to the recovery of other petroleum materials having a higher A.P.I. gravity that are difficult to recovery such as petroleum residues containing high paraffinic or microcrystalline wax contents.

This invention relates to a process which comprises a combination of features which include i. providing a thermal gradient in the region of the surface of a viscous body of petroleum residue or asphalt deposit, ii. locating an archimedean screw-type pump in said region such that the inlet of the pump is proximate of the surface of the deposit and the outlet of the pump is openly connected to transport means for passing the deposit from the pump to a shore receiving system used for the recovery of the deposit, iii. passing a skimmer in a reciprocating motion relative to the pump such that deposit is pushed by the skimmer toward the pump within said region and then withdrawn from the pump in a direction away from the pump, and iv. transporting deposit into the inlet of the pump, through the outlet of the pump and to said shore receiving system.

Preferably, the process of the invention relates to the removal of petroleum residues of relatively high viscosity from pits and ponds by floating an archimedean screw-type pump in the pit or pond such that its inlet is proximate of the surface of the pit or pond, providing a thermal gradient about the pump such that less viscous components of the petroleum residues become more highly concentrated in the vicinity of the inlet to the pump, utilizing a positive pressure on a surface layer of the residues in the pit or pond such that a flow of petroleum residue is created toward the inlet to the pump and a petroleum residue composition of a lower viscosity than that of the remainder of the pit or pond is displaced to the inlet of the pump and the displaced residue is pumped from the pit or pond to a shore facility.

The invention relates to an apparatus for the removal of petroleum residues of relatively high viscosity from pits and ponds which comprises a floating archimedean screw-type pump in the pit or pond such that its inlet is proximate of the surface of the pit or pond, means for providing a thermal gradient about the pump such that less viscous components of the petroleum residues become more highly concentrated in the vicinity of the inlet to the pump, means for applying a positive pressure on a surface layer of the residues in the pit or pond such that a flow of petroleum residue is created toward the inlet to the pump and a petroleum residue composition of a lower viscosity than that of the remainder of the pit or pond is displaced to the inlet of the pump such that the displaced residue is pumped from the pit or pond to a shore facility.

DETAILED DESCRIPTION OF THE INVENTION

Figures 1, 2:
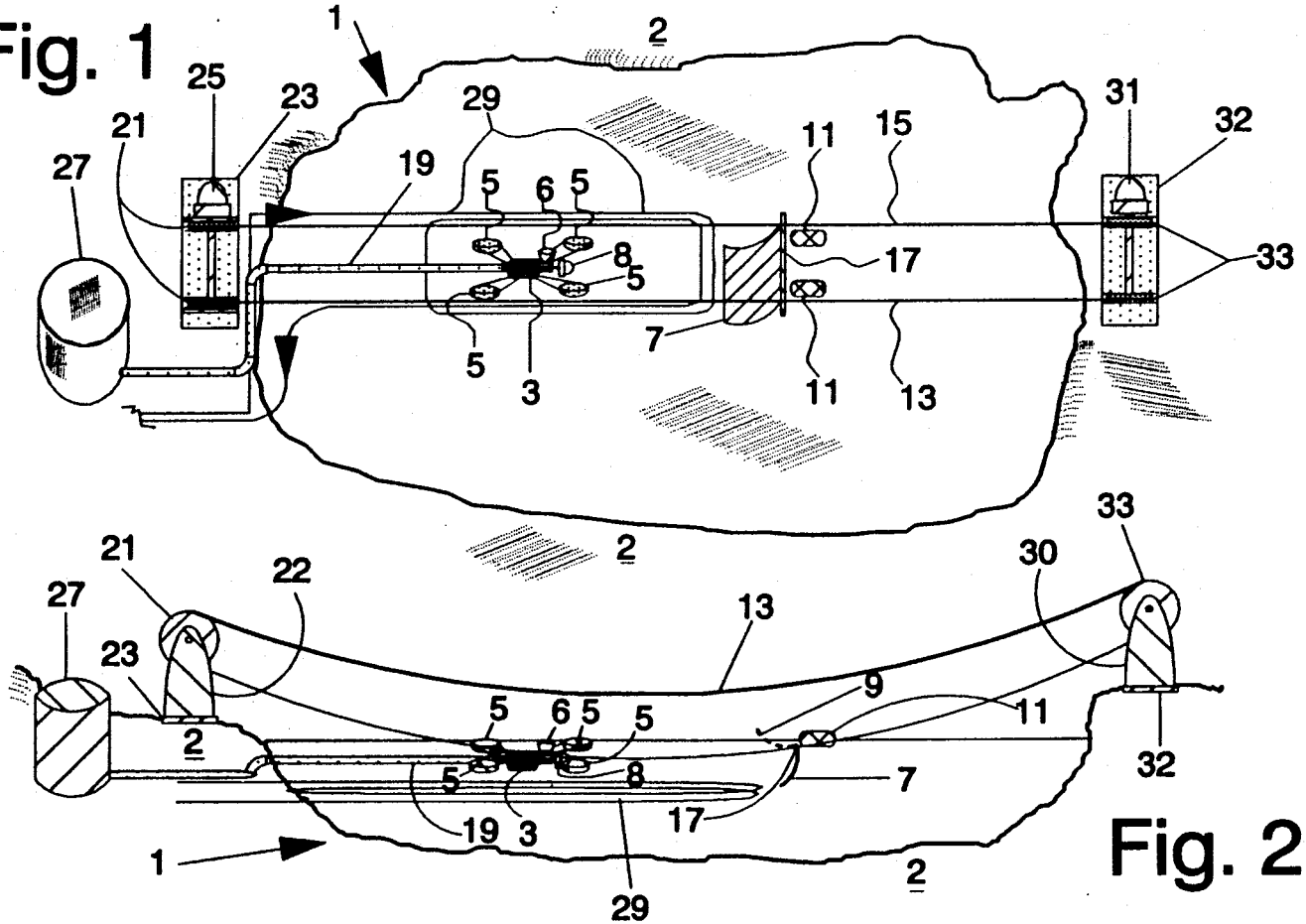
FIG. 1 is a schematic top view of a pitch pond or pit containing an apparatus assembly including the apparatus of the invention, suitable for carrying out the process of the invention.
FIG. 2 is a side view showing a cross-sectional view of the pond or pit illustrating the relative arrangement of the equipment characterized in FIG. 1.

All petroleum residues and asphalts contain a molecular distribution that varies significantly. As a general rule, the lower the molecular weight of a component in the petroleum residue or asphaltic compositions, the less viscous will be the component. The less viscous components may not be significantly lower boiling than the less volatile components of the petroleum residue or asphaltic compositions, but when concentrated, they are clearly less viscous and more flowable at lower temperatures.

It has been discovered that thermal treatment of petroleum residues and asphalts causes the less viscous components of those compositions to rise and sufficiently separate from the more viscous components of the compositions such that there is caused a gradient reduction in viscosity in the compositions. This invention takes advantage of that phenomena and lowers the viscosity of the compositions in a manner that facilitates their removal from pits and ponds.

The invention utilizes localized introduction of heat to a large body of deposited petroleum residues or asphalt such that the temperature in a predominant portion of the body is unaffected by such localized introduction of heat. However, the invention utilizes localized heating to alter the composition of the residue or asphalt in the proximity of the heating and to cause less viscous residue or asphalt composition to migrate into the localized heated region. This sequence causes the process to be continuous in the sense that the solvation of the deposit, which is subject to removal through an archimedean screw-like pump, is effected by a extracting a higher concentration of the less viscous components from other portions of the body being treated.

The invention incorporates localized heating of a relatively large body of viscous petroleum residues or asphalt deposit so as to cause seepage of less viscous components of the deposit to the area of the localized heating such that the concentration of the less viscous components in such area is increased and the flow characteristics of the deposit in the area of localized heating is improved, i.e., the deposit exhibits a less viscous nature.

The drawings illustrate one particular mode for practicing the invention. Other modes are contemplated and the invention is not intended to be limited to that depicted in the drawings.

With respect to FIGS. 1 and 2, there is shown pond or pit area 1 contained by land mass 2. Pond or pit 1 may contain a viscous body of petroleum residues deposit or an asphalt deposit (natural or synthetic). Located offshore in area 1 is archimedean screw-like pump 3 suspended in the viscous body by floatation devices 5. Surrounding an area about pump 3 within area 1 is thermal transfer line or lines 29, supplied with heat from an offshore system (not shown). As shown in FIGS. 1 and 2, line 29 comprises a loop arrangement about pump 3 to insure the localization of heat in the vicinity of pump 3. The arrows in line 29 characterize the flow within the line.

Line 29 may be an electrically or fluid heated pipe or a system that effects heating of the deposit residing about it by contact heating. Illustrative of the following is a porous piping in which heated steam fed from land is caused to bubble from orifices in the piping into the surrounding deposit and by contact heating, raises the temperature of the deposit. This induces a thermal gradient about line 29 and also about pump 3.

It has been determined that if one were to rely solely on the induced temperature gradient in the localized regions of a pit or pond to effect removal of the deposit, there would be insufficient flow into the pump to efficiently support the pumping action. In order to induce sufficient of the very viscous deposit to the induction end of the pump, inlet 6, it is desirable to introduce a positive pressure on a thermally treated portion of the deposit so that a mass thereof is transported to the inlet of the pump. This can be easily accomplished by positioning a blade or skimmer 7 in the localized heated region of the pit or pond 1 surrounding pump 3 and using travel guide cables 13 and 15, to which blade or skimmer 7 is affixed, in this case, through frame 17, to move the blade or skimmer 7 forward toward pump 3 while it cuts into the viscous body and forces deposit into the inlet 6 of pump 3. As shown in FIG. 2, blade or skimmer 7 is capable of pivoting in frame 17 such that on withdrawal from pump 3, after having forced a load of the deposit into the pump inlet 6, the blade or skimmer 7 is pushed out into hatched line position 9 on the surface of the viscous body. As a result, blade or skimmer 7 rides during withdrawal on the surface of the viscous body without introduction of significant resistance to movement. Frame 17 is affixed to flotation devices 11 which serve to keep frame 17 and blade or skimmer 7 in the desired positions relative to the viscous body of deposit materials.

The movement of blade or skimmer 7 is controlled by matched pulley systems 21 and 33. Their top and side views are depicted in FIGS. 1 and 2. Each pulley system is driven by its own motor, 25 and 31. The pulley systems are located on support surfaces 23 and 32 and each system, 21 or 33, rotates on a common axle for each pair of pulley wheels that are mounted in support walls 22 and 30 respectively. Of course, support walls are provided on opposite sides of the pair of pulley wheels.

As shown in FIGS. 1 and 2, the outlet of pump 3 is connected to withdrawal pipe 19 and the driving force for carrying the deposit is the pump 3 driven by motor 8. Motor 8 may be electrical or gasoline controlled. The removed deposit is collected in storage tank 27. In certain circumstances it may be desirable to heat withdrawal pipe 19 to facilitate the removal of the deposit via the pump and the withdrawal pipe. For example, should the viscosity of the deposit in pipe 19 increase when the pipe is outside of the heated region about pump 3, and the viscosity is too great for pump 3 to handle, then by raising the temperature of pipe 19, the viscosity of the deposit in pipe 19 can be sufficiently lowered to facilitate the removal operation. Such heating of pipe 19 can be effected by electrically heating the pipe by providing an electrical wrapping around pipe 19 at least in those sections of pipe 19 where sufficient "freezing" of deposit occurs that removal of the deposit is deleteriously inhibited.

Figure 3:
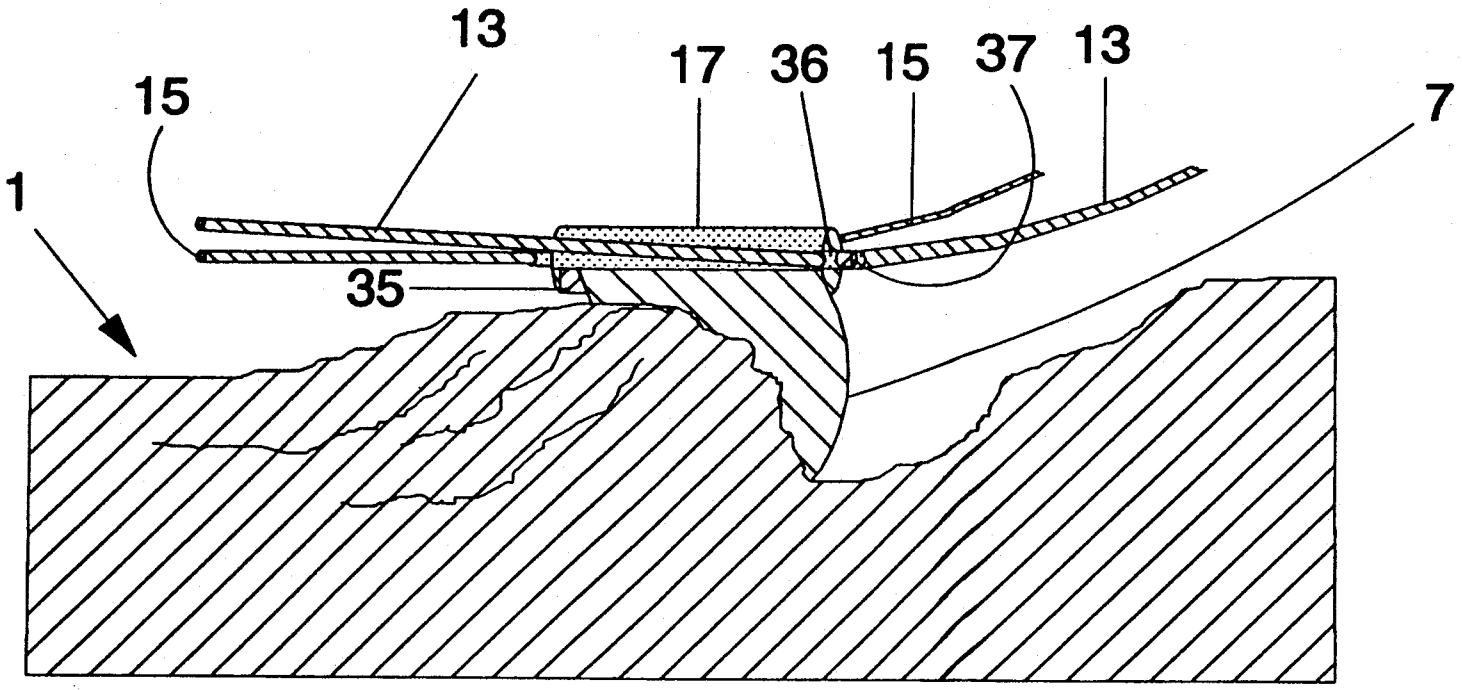
FIG. 3 is a three quarter perspective view of a skimmer or blade assembly in action in the pond or pit serving to move the pond or pit deposits to the removal pump.

FIG. 3 provides a more detailed characterization of the operation of blade or skimmer 7 as it cuts through viscous body 1 pushing deposit toward pump 3. As shown, blade or skimmer 7 cuts into the body 1 and forces a portion of the material forward to the pump. Frame 17 comprises a pivot axle 37 that extends the length of the frame. The axle 37 is a rod with threaded ends that allow the bolting of the axle to frame 17. Axle 37 extends through sleeve 36 which coexists at the other side of frame 17. Extending through sleeves 36 are cables 13 and 15, see FIGS. 1 and 2 above. Cables 13 and 15 are held in fixed positions by sleeves 36 so that as the cables move, so moves frame 17. Frame 17 securely holds blade or skimmer 7 by sliding axle 37 through a tubular end in blade or skimmer 7 so that blade or skimmer 7 can pivot or rotate on axle 37. Blade or skimmer 7 is held in the position shown in FIG. 3 by backwall 35 which forms part of frame 17. Backwall 35 acts as a stop for blade or skimmer 7 so that its rotation is a counterclockwise direction is arrested so that it is maintained in the vertical position shown in FIGS. 2 and 3. However, frame 17 is suitably constructed that blade or skimmer 7 can freely rotate in a clockwise direction when the blade or skimmer 7 is withdrawn from pump 7. Needless to say that whether blade or skimmer 7 rotates clockwise or counterclockwise when withdrawn from pump 3 is dependent on the positional relationship taken for these instruments.

In FIGS. 1 and 2, blade or skimmer 7 is positioned so that when it is pushed toward pump 3, blade or skimmer 7 is pushed in a counterclockwise direction. If blade or skimmer 7 were located on the other side of pump 3, then, of course, it would be pushed in a clockwise direction.

Figure 4:
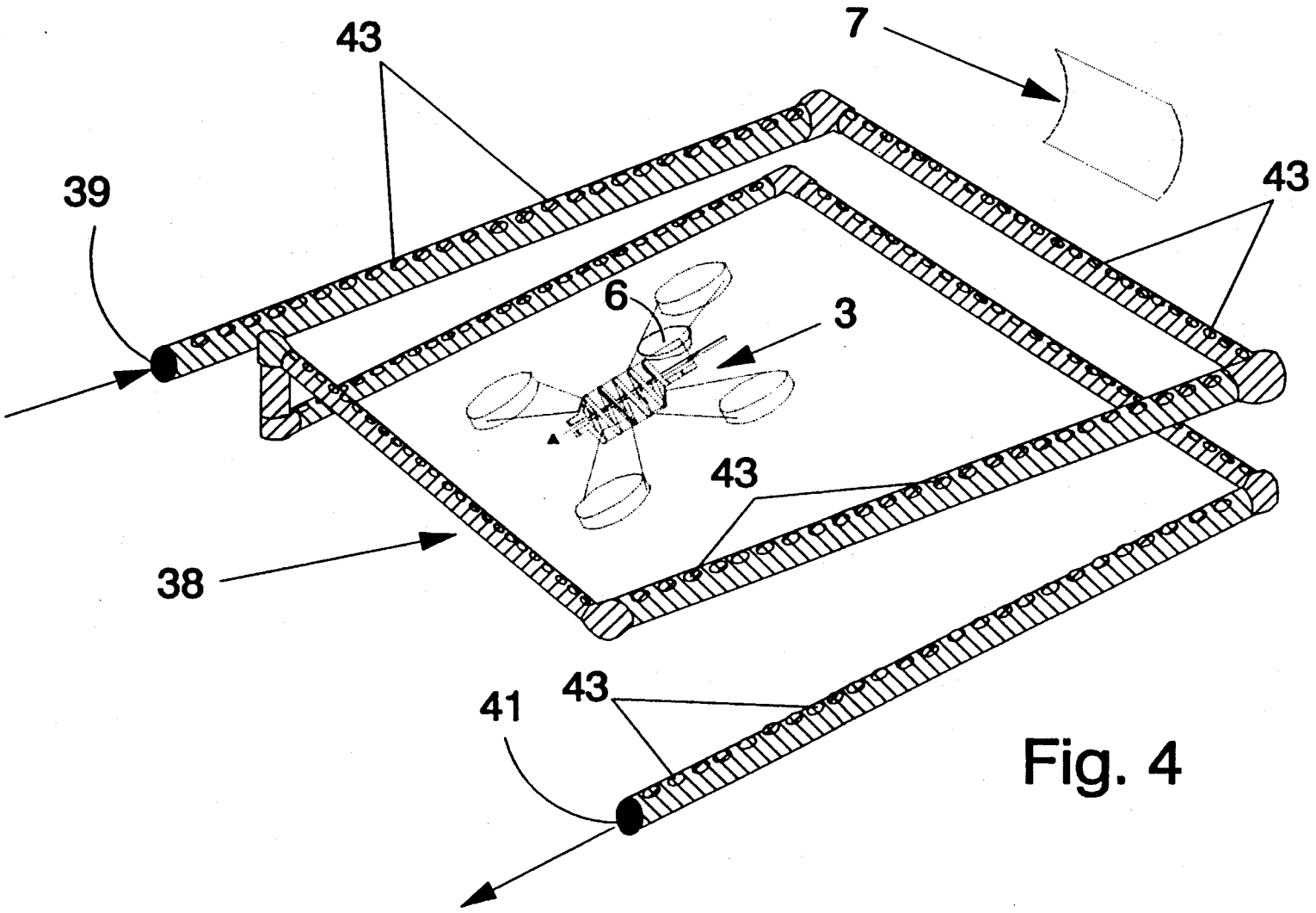
FIG. 4 is a perspective view of a steam sparging device with a phantom illustration of the pump and skimmer.

A desirable method for heating the region of pond or pit 1 around pump 3 is depicted in FIG. 4. As a replacement for line 29 as shown in FIGS. 1 and 2, one may employ tubular coil 38 according to the arrangement of FIG. 4. As shown in FIG. 4, coil 38 possesses a tubular inlet 39 and a tubular outlet 41. Located on each tubular leg of coil 38 are sparging holes 43, each of which openly connect with the interior of each of the tubular legs. The relationship of pump 3 containing inlet 6 and blade or skimmer 7 to tubular coil 38 is established by showing a phantom representation of pump 3 and blade or skimmer 7 in FIG. 4. The operation of coil 38 is simple. A heated fluid, preferably steam, is supplied through the tubular inlet 39 and issues through sparging holes 43 as it circulates through coil 38. Enough heated fluid is supplied to coil 38 that a portion remains to pass through outlet 41. Uniformity of the sparge streams that issue through and from sparging holes 43 can be controlled by correlating the diameters of the holes to the steam pressure in the various portions of coil 38.

Figure 5:
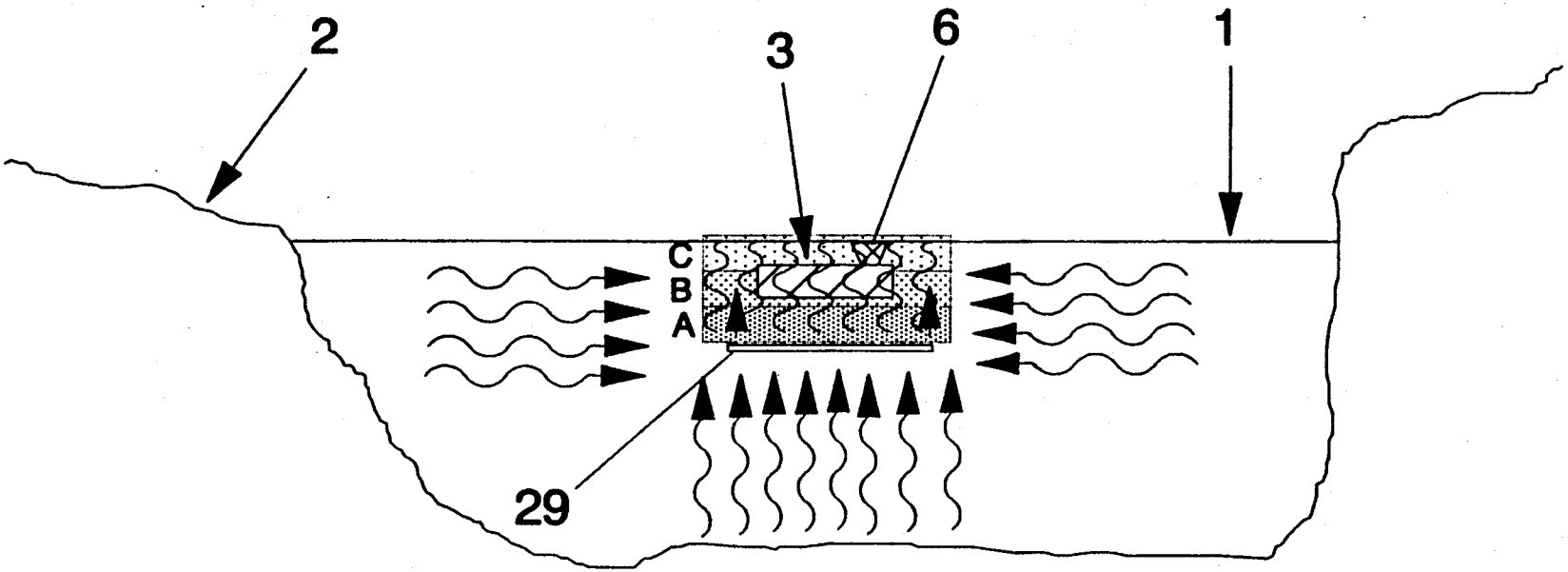
FIG. 5 is a cross-sectional view of a general characterization of the principles of the process of the invention.

The operation of the process of the invention is further demonstrated in the schematic representation depicted in FIG. 5. As shown in FIG. 5, there is located line 29 in a region below and around pump 3 containing inlet 6, whose entry port is positioned at about the surface of viscous body 1. In this embodiment, line 29 can be a variety of heating means but in this case, it is represented by coil 38 of FIG. 4. As steam issues from sparging holes 43 into the viscous body located about pump 3, steam represented by the wiggly lines courses upward and heats the region around pump 3. This causes a temperature gradient to be created from line 29 to the surface of body 1. This temperature gradient is illustrated by zones A, B and C, each illustrated as differently shaded rectangular zones. The deeper shaded zone A is located closest to line 29, therefore that zone is at a higher temperature than zones B and C. Logically, zone B is hotter than zone C. Because of this temperature differential, less viscous materials are concentrated to the greatest extent, on a relative basis, in the hottest zone, in this case zone A. Because line 29 is a loop that allows deposit to pass through it, less viscous components in the deposited material located below line 29 are caused to migrate upward to replace less viscous materials removed to a higher level in the viscous body. This also takes place outside the loop of line 29. Thus, heating of the body in a region causes striations of less viscous material to be eluted from sections of the viscous body into other sections of the viscous body. As a consequence of heating one section of the viscous body, less viscous materials are extracted upwardly in a larger region of the body extending outside of the heated region, all effected without having to heat the larger region.

As pointed out above, petroleum residues vary from site to site. In some cases, the residues are waxy and in some cases they are viscoelastic. In other cases, the residues contain sufficient byproduct chemicals that they have a sufficient low enough viscosity to allow reasonable flow under the recovery conditions described above. Therefore, there are situations where sparged steam might not adequately raise the temperature of the body 1 at the region about the pump to insure adequate deposit removal. In such a case, an alternative to the use of sparge ring is a closed loop heating coil which circumscribes the heating region about the pump. The coil would be heated by a suitably heated fluid brought to a temperature greater than 100° C. Suitable heated fluids comprise steam or commercially available heat transfer fluids.

However, in those cases where the residues are so waxy or visco-elastic that they tend to plug the inlet of the archimedean screw-like pump 3, there are simple alterations to the pump that can be made that will insure the easy introduction of the residue deposits to the blade of the pump without holdup at the hopper inlet 6 of the pump. One such alteration is shown in FIG. 6.

Figure 8:
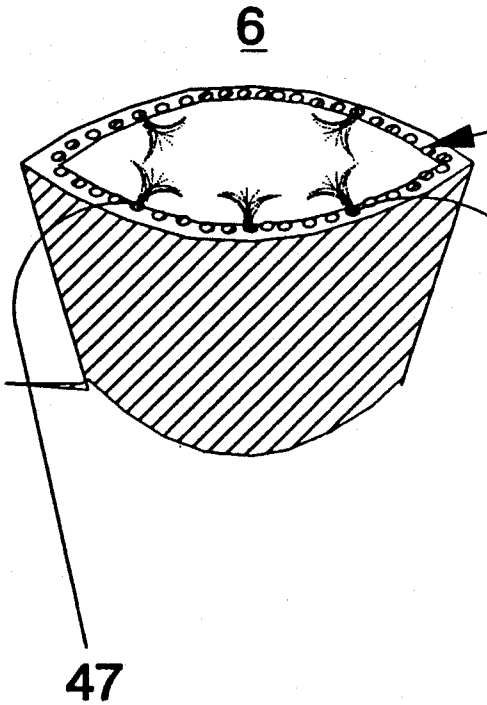
FIG. 8 is a perspective blow-up of the inlet containing a sparge ring.
Figure 6:
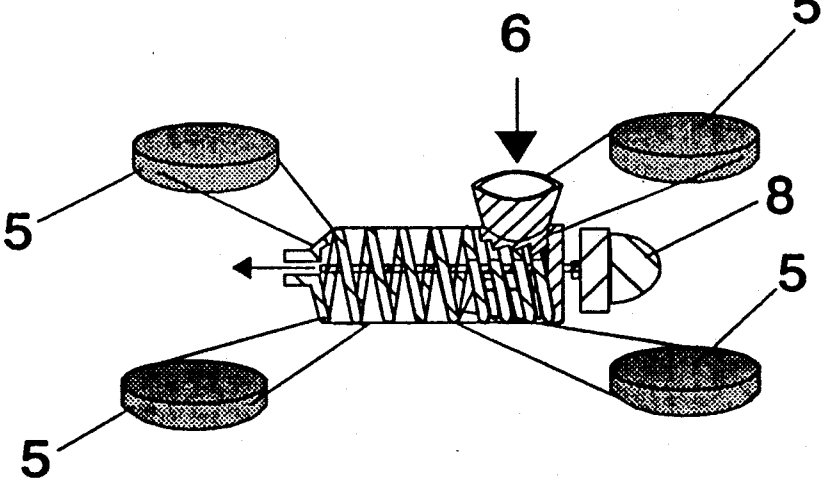
FIG. 6 is perspective view of the pump, partially shown in a cross-sectional view.

FIG. 6 shows an alteration of pump 3 which includes the use of a sparger ring 45 at the entrance of hopper inlet 6. Sparger ring 45 comprises a series of nozzles circumscribing the entrance of hopper 6. As a flow aid to deposit fed to the hopper entrance, as shown in FIG. 8, hot water or well-known chemical flow aid mixtures can be sprayed, shown as spray streams 47, from all or many of the nozzles into the interior of hopper inlet 6. This procedure facilitates the feeding to the blades of the pump when the deposit being fed is almost intractible and helps to reduce the drag coefficient on the hopper walls and product delivery pipe 19, see FIGS. 1 and 2.

Figure 7:
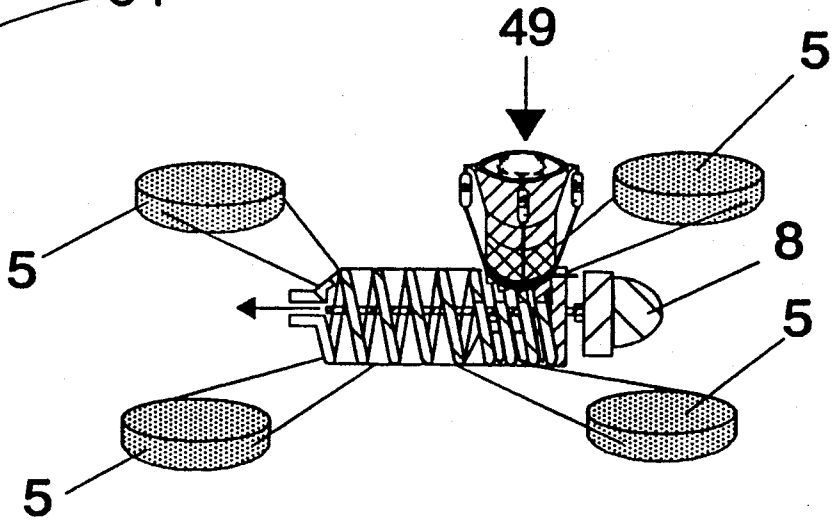
FIG. 7 is perspective view of the pump, partially shown in a cross-sectional view.
Figure 9:
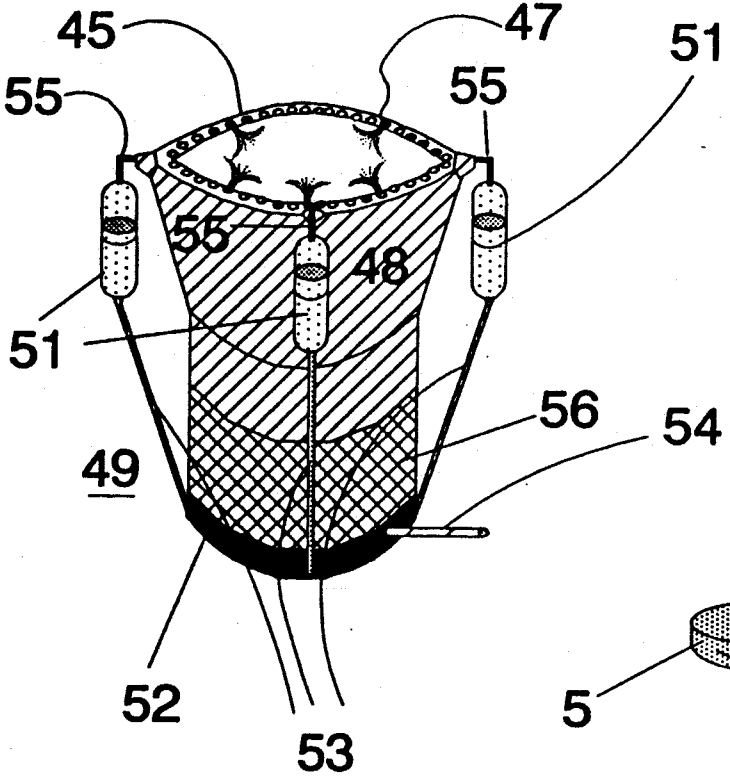
FIG. 9 is a perspective blow-up of the inlet containing a sparge ring, plus an adjustable inlet hopper with a piston arrangement for raising, lowering and directing the hopper.

FIG. 7 illustrates an improvement in the hopper inlet design which provides maximum adaptibility to flow and feed considerations. In this figure, the hopper inlet 49 is a modification of the hopper inlet 6 design of FIG. 6. As shown in FIG. 9, hopper inlet 49 comprises housing 48 and contains sparger ring 45 and spray streams 47 discussed previously. In addition, hopper housing 48 is circumscribed by four (4) hydraulically or pneumatically controlled pistons 51, three of which are shown in FIG. 9. The pistons 51 are affixed to hopper housing 48 by piston brackets 55 and to fixed collar 52 by brackets 53. Collar 52 is fixedly linked to the outer shell of pump 3. Each of the pistons 51 contain fluid tubings 54, for supplying fluid, air or liquid, to actuate or control the individual pistons. By virtue of separate controls over the operation of the pistons 51, hopper housing 48 can be raised or lowered uniformly or raised or lowered nonuniformly, i.e., eccentrically, at an one or more piston 51 sites. There is provided in hopper 49, internal sleeve 56 which is fixed to the shell of pump 3. The lower end of housing 48 is another sleeve that mates with sleeve 56 so that housing 48 can be slid up or down sleeve 56. By making sleeve 56 of a material that is flexible, such as rubber, pistons 51 can also operate to bend the hopper inlet in any direction, such as toward or away from the direction of deposit flow actuated by blade or skimmer 7.

The arrangement of FIGS. 7 and 9 works as follows. There are occasions when the surface of the pit or pond will vary during the recovery operation, mainly owing to the response of the viscous body 1 to either too little or too much delivery of deposit by the action of blade or skimmer 7. There will be times when the hopper inlet should be lowered or raised or turned into or away from the direction of deposit flow. All of these conditions can be readily accomodated by the novel hopper design for the pump, as depicted in FIGS. 7 and 9.

I claim:

1. A process for the recovery of petroleum residue deposits and asphalt deposits characterised by the steps of i. providing a thermal gradient in the region of the surface of a viscous body of petroleum residue or asphalt deposit, ii. locating an archimedean screw-type pump in said region such that the inlet of the pump is proximate of the surface of the deposit and the outlet of the pump is openly connected to transport means for passing the deposit from the pump to a shore receiving system used for the recovery of the deposit, iii. passing a skimmer in a reciprocating motion relative to the pump such that deposit is pushed by the skimmer toward the pump within said region and then withdrawn from the pump in a direction away from the pump, and iv. transporting deposit into the inlet of the pump, through the outlet of the pump and to said shore receiving system.

2. The process of claim 1 characterised in that the skimmer is controlled by a land based cable arrangement.

3. The process of claim 1 characterised in that the thermal gradient is effected by placing a heating device in the viscous body in the region of the pump.

4. The process of claim 3 characterised in that the heating device utilizes contact heating.

5. The process of claim 4 characterised in that the heating device sparges heating fluid to the body.

6. The process of claim 1 characterised in that the pump and skimmer are provided on flotation devices in the body.

7. The process of claim 1 characterised in that the pump is provided with an inlet containing added lubrication for the feeding of deposit to the pump.

8. The process of claim 7 characterised in that the lubrication is provided by sparging lubricant to the interior of the inlet.

9. The process of claim 8 characterised in that the lubrication is provided by sparging hot water to the interior of the inlet.

10. The process of claim 8 characterised in that the lubrication is provided by a chemical mixture.

11. The process of claim 1 characterised in that the pump contains an adjustable hopper inlet.

12. The process of claim 11 characterised in that the adjustable hopper inlet can be raised or lowered.

13. The process of claim 11 characterised in that the adjustable hopper inlet can be bent in at least one direction.

14. A process for the removal of petroleum residues of relatively high viscosity from pits and ponds characterized by the steps of floating an archimedean screw-type pump in the pit or pond such that its inlet is proximate of the surface of the pit or pond, providing a thermal gradient about the pump such that less viscous components of the petroleum residues become more highly concentrated in the vicinity of the inlet to the pump, utilizing a positive pressure on a surface layer of the residues in the pit or pond such that a flow of petroleum residue is created toward the inlet to the pump and a petroleum residue composition of a lower viscosity than that of the remainder of the pit or pond is displaced to the inlet of the pump and the displaced residue is pumped from the pit or pond to a shore facility.

15. An apparatus for the removal of petroleum residues of relatively high viscosity from pits and ponds characterized the combination comprising a floating archimedean screw-type pump in the pit or pond such that its inlet is proximate of the surface of the pit or pond, means for providing a thermal gradient about the pump such that less viscous components of the petroleum residues become more highly concentrated in the vicinity of the inlet to the pump, means for applying a positive pressure on a surface layer of the residues in the pit or pond such that a flow of petroleum residue is created toward the inlet to the pump and a petroleum residue composition of a lower viscosity than that of the remainder of the pit or pond is displaced to the inlet of the pump such that the displaced residue is pumped from the pit or pond to a shore facility.

16. The apparatus of claim 15 characterised in that the means for providing the positive pressure is a skimmer that is controlled by a land based cable arrangement.

17. The apparatus of claim 16 characterised in that the pump and skimmer are provided on flotation devices in the body.

18. The apparatus of claim 15 characterised in that the thermal gradient means is a heating device in the viscous body in the region of the pump.

19. The apparatus of claim 18 characterised in that the heating device utilizes contact heating.

20. The apparatus of claim 19 characterised in that the heating device sparges heating fluid to the body.

21. The apparatus of claim 15 characterised in that the pump is provided with an inlet means for providing lubrication for the feeding of deposit to the pump.

22. The apparatus of claim 21 characterised in that the inlet means is capable of sparging lubricant to the interior of the inlet.

23. The apparatus of claim 22 characterised in that the inlet means is capable of sparging hot water to the interior of the inlet.

24. The apparatus of claim 15 characterised in that the pump contains and adjustable hopper inlet.

25. The apparatus of claim 24 characterised in that the adjustable hopper inlet can be raised or lowered.

26. The apparatus of claim 24 characterised in that the adjustable hopper inlet can be bent in at least one direction.

* * * * *